US007764918B2

(12) United States Patent
Kawagoe

(10) Patent No.: US 7,764,918 B2
(45) Date of Patent: Jul. 27, 2010

(54) CLEANING DEVICE AND IMAGE FORMING APPARATUS

(75) Inventor: Katsuya Kawagoe, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 623 days.

(21) Appl. No.: 11/740,570

(22) Filed: Apr. 26, 2007

(65) Prior Publication Data

US 2007/0286654 A1 Dec. 13, 2007

(30) Foreign Application Priority Data

Apr. 26, 2006 (JP) ..... 2006-122104

(51) Int. Cl.
*G03G 21/00* (2006.01)

(52) U.S. Cl. ..... 399/350; 399/351; 399/353

(58) Field of Classification Search ..... 399/350, 399/351, 353

See application file for complete search history.

(56) References Cited

U.S. PATENT DOCUMENTS

| | | | | |
|---|---|---|---|---|
| 5,442,428 | A | 8/1995 | Takahashi et al. | |
| 5,784,674 | A * | 7/1998 | Iseki et al. | 399/297 |
| 5,890,030 | A | 3/1999 | Namekata et al. | |
| 5,983,060 | A | 11/1999 | Namekata et al. | |
| 6,212,351 | B1 | 4/2001 | Kawagoe et al. | |
| 6,374,073 | B2 * | 4/2002 | Ozaki et al. | 399/298 |
| 6,618,565 | B2 | 9/2003 | Sawai et al. | |
| 6,697,595 | B2 | 2/2004 | Kawagoe et al. | |
| 6,741,821 | B2 | 5/2004 | Sugino et al. | |
| 6,785,500 | B2 | 8/2004 | Takahashi et al. | |
| 6,829,450 | B2 | 12/2004 | Tamiya et al. | |
| 6,947,693 | B2 | 9/2005 | Kamiya et al. | |
| 2003/0108360 | A1 * | 6/2003 | Ogasawara | 399/159 |
| 2003/0118359 | A1 | 6/2003 | Ogiyama et al. | |
| 2004/0022557 | A1 * | 2/2004 | Kudo | 399/167 |
| 2004/0114951 | A1 | 6/2004 | Kawagoe | |
| 2005/0232667 | A1 * | 10/2005 | Iwata | 399/353 |
| 2006/0116228 | A1 | 6/2006 | Kamiya et al. | |
| 2006/0127116 | A1 | 6/2006 | Ogiyama et al. | |
| 2007/0014595 | A1 | 1/2007 | Kawagoe | |

FOREIGN PATENT DOCUMENTS

| | | |
|---|---|---|
| JP | 11-024507 | 1/1999 |
| JP | 2001-318541 | 11/2001 |
| JP | 2006-078679 | 3/2006 |

OTHER PUBLICATIONS

U.S. Appl. No. 10/724,998, filed Dec. 2, 2003, Kudo et al.

* cited by examiner

*Primary Examiner*—David M Gray
*Assistant Examiner*—G. M. Hyder
(74) *Attorney, Agent, or Firm*—Oblon, Spivak, McClelland, Maier & Neustadt, L.L.P.

(57) ABSTRACT

A cleaning device includes a first cleaning portion provided at a position where a belt transfer body is moved after transfer, and includes a second cleaning portion having a cleaning member which contacts the belt transfer body, which is located at an end of the belt transfer body in the perpendicular direction to the moving direction of the belt transfer body. There is a fixing member for pressing the belt transfer body to the cleaning member. The fixing member is located at a position opposing the cleaning member with the belt transfer body therebetween.

11 Claims, 6 Drawing Sheets

CLEANING DEVICE AND IMAGE FORMING APPARATUS

BACKGROUND OF THE INVENTION

1. Field of the Invention

The present invention relates to a cleaning device and an image forming apparatus, and more particularly to a cleaning mechanism for a belt for use in the transfer process of image formation.

2. Discussion of the Background

In an image forming apparatus, for example, a multifunction printer, a photocopier, a facsimile machine, a printer or a printing machine, a latent electrostatic image formed on a photoreceptor functioning as an image bearing member is visualized by toner. Then, the visualized image is transferred to a recording medium, for example, a sheet form recording medium (e.g., transparent sheet) and fixed by a fixing device to produce a copier or print output.

Images formed on a photoreceptor are not only monochrome images but also full color images. In the transfer process in which full color images are formed, there is a structure in which each color image is sequentially transferred in a process of moving a recording medium through the image forming portion having multiple photoreceptors arranged side by side. In addition thereto, for example, published unexamined Japanese patent application No. (hereinafter referred to as JOP) 2006-078679 describes a structure in which a primary image transfer is performed using an intermediate body, for example, a belt, and the obtained resultant overlapped image is secondarily transferred at one time to a recording medium.

Cleaning of the intermediate transfer body is performed to remove remaining toner and/or paper dust after the transfer of the overlapped image to the recording medium at one time. With regard to the structure for the cleaning, for example, JOP 2001-318541 describes a structure having a blade and a brush roller which is brought into contact with an intermediate transfer body.

As described in JOP 2001-318541, it is well known that toner and paper dust remaining on a belt functioning as an intermediate transfer body tend to be attached at the ends in the breadth direction of the belt. Thus, with regard to the cleaning of an intermediate transfer body, there can be used a structure having at least a cleaning member at the ends located in the breadth direction of the belt or a belt form cleaning member moving along the breadth direction to scrape toner and/or paper dust attached to the surface of the belt near its ends. However, when toner and paper dust attached to the surface of a belt near its ends are removed, the following problems may arise.

FIG. 10 represents a structure having a belt A functioning as an intermediate transfer body, a cleaning blade B and a cleaning brush C. The cleaning blade B and the cleaning brush C are brought into contact with the belt A such that all the area in the breadth direction of the belt A is covered. In this structure, the cleaning blade B banks up or the cleaning brush C scrapes toner T remaining on the belt covering the image formation area on the intermediate transfer belt. Banks up means that toner accumulates in a mound, pile, or ridge. However, when the toner T banked up by the blade is accumulated, the toner T may be pushed to the ends in the breadth direction of the blade B. As a result, the toner may be brimmed over or slipped from the ends of the cleaning blade A or the cleaning brush B as indicated by the arrows illustrated in FIG. 10.

The toner slipped from or brimmed over the end of such a cleaning device scatters around and tends to contaminate or abrade peripherally arranged devices. Furthermore, the toner still remaining on and attached to the belt easily forms toner filming on the belt surface. This may lead to deterioration of charging characteristics of an intermediate transfer body and damage to the cleaning device.

Another collecting member (D represented in FIG. 10) or a sealing member dedicated to cover the end of the belt may be provided. However, it is difficult to completely prevent the toner from slipping from the end of the collecting member. When an air-tight sealing member is provided, the internal pressure thereof may abnormally increase and blow up. Thus, another member may be provided to prevent these problems and it is inevitable to make the structure complicated.

SUMMARY OF THE INVENTION

Because of these reasons, the present inventor recognizes that a need exists for a cleaning device and an image forming apparatus which can prevent slipping of toner so that contamination of and/or damage to other devices can be caused by toner scattering without inviting a complicated structure.

Accordingly, an object of the present invention is to provide a cleaning device and an image forming apparatus which can prevent slipping of toner and contamination of and/or damage to other devices caused by toner scattering without inviting a complicated structure.

Briefly this object and other objects of the present invention as hereinafter described will become more readily apparent and can be attained, either individually or in combination thereof, by a cleaning device. The cleaning device includes a first cleaning portion provided at a position where a belt transfer body is moved after transfer; and a second cleaning portion including a cleaning member(s) which contacts the belt transfer body. The cleaning member is located at the end(s) of the belt transfer body in a perpendicular direction to the moving direction of the belt transfer body, and a fixing member for pressing the belt transfer body to the cleaning member. The fixing member is located at a position opposing the cleaning member with the belt transfer body therebetween.

According to one embodiment, in the cleaning device mentioned above, the cleaning member includes a brushing member on the side thereof which contacts with the belt transfer body.

According to another embodiment, in the cleaning device mentioned above, the fixing member includes a brushing member on the side thereof which contacts with the belt transfer body.

According to another embodiment, in the cleaning device mentioned above, the cleaning member has a slant side relative to the breadth direction of the belt transfer body. The slant side is located on the upstream side relative to the moving direction of the belt transfer body.

According to another embodiment, in the cleaning device mentioned above, the slant side is slant (open toward the end of the breadth direction of the belt transfer body) such that toner located on the end side is moved toward the center of the transfer belt relative to the breadth direction thereof.

According to another embodiment, in the cleaning device mentioned above, the slant side is an oblique line in a plain view of the cleaning member.

According to another embodiment, in the cleaning device mentioned above, the cleaning member is located at least a predetermined length (e.g., 2 mm) away from the end(s) of an image formation area of the belt transfer body in the perpendicular portion.

As another aspect of the present invention, an image forming apparatus is provided which includes an image bearing member for bearing a latent image thereon, a charging device for charging the image bearing member, a developing device for developing the latent image with a developing agent, a belt transfer body for transferring the latent image, a discharging device for discharging the image bearing member, the cleaning device mentioned above and a detecting device for detecting the moving speed of the belt transfer body. The detecting device includes a fixing member located opposing the cleaning member with the transfer belt therebetween.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
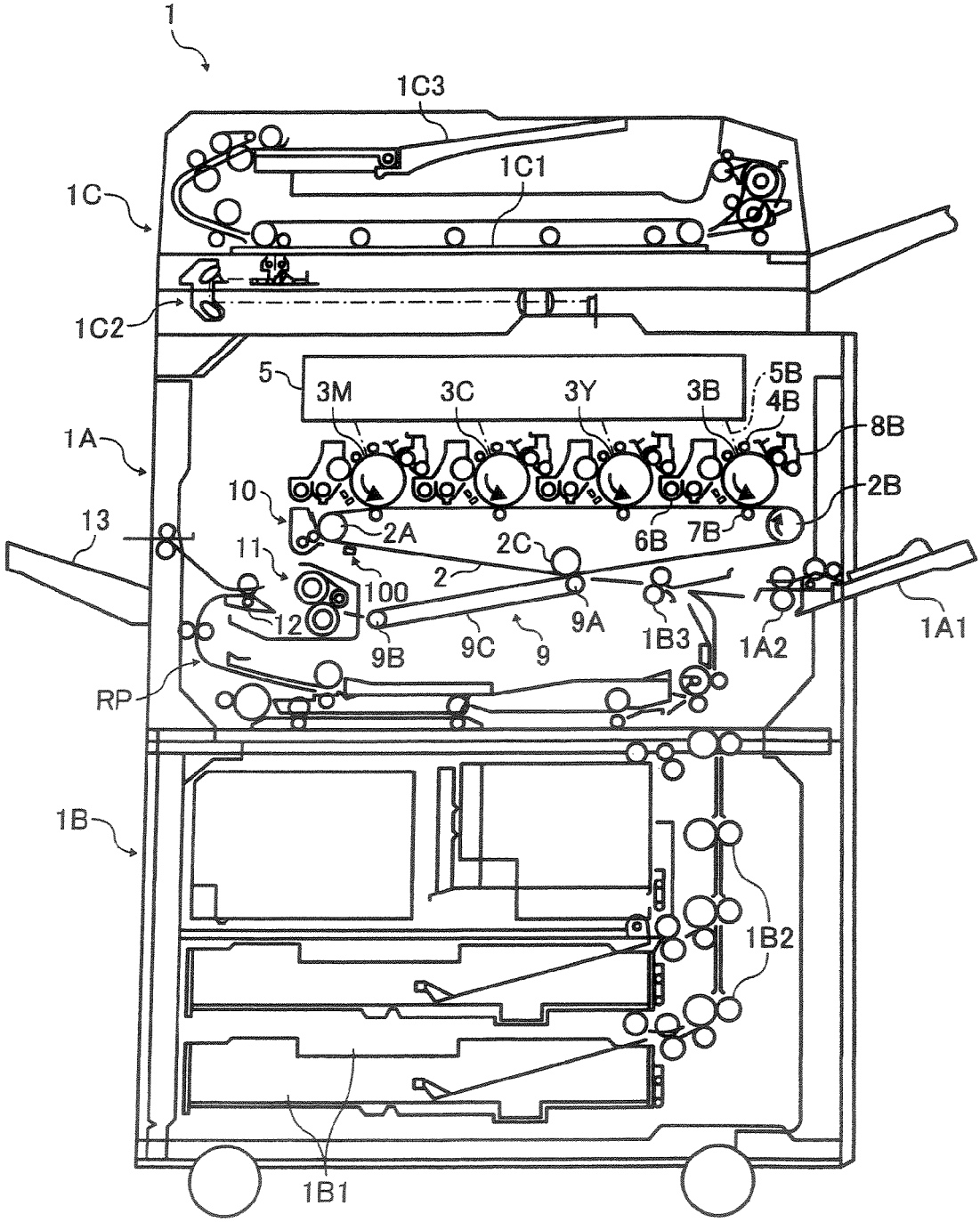
FIG. 1 is a schematic diagram illustrating an example of the image forming apparatus to which the cleaning device of the present invention is applied.

Referring now to the drawings, where like reference numerals designate identical or corresponding parts throughout the several views, and more particularly to FIG. 1 thereof, there is shown the structure of an example of an image forming apparatus 1 having the cleaning device of the present invention.

The image forming apparatus 1 illustrated in FIG. 1 has a tandem type structure. The tandem type structure has multiple photoreceptors functioning as image bearing members which can form color images corresponding to color separation. The photoreceptors are arranged side by side. A toner image formed on each of the photoreceptors is overlapped on an intermediate transfer body. The overlapped image is transferred to a recording medium, for example, a sheet, at one time to obtain multi-colored images. The image forming apparatus may be implemented as a color printer, color photocopier, color facsimile device, color multifunction printer, or a color printing machine, for example. The invention may also be implemented as corresponding monochrome (e.g., black and white) devices.

In FIG. 1, in the image forming apparatus 1, an image formation portion 1A is situated in the center relative to the vertical direction. Under the image formation portion 1A, a recording medium feeding portion 1B is provided. Above the image formation portion 1A, a document scanning portion 1C having a document setting table 1C1 is provided.

In the image formation portion 1A, a transfer device including an intermediate transfer belt 2 is provided as an intermediate transfer body having an extension in horizontal direction. In the image forming portion 1A, photoreceptors 3B, 3Y, 3C and 3M, which can bear a color image (yellow, magenta, cyan and black), are arranged side by side along the extension phase of the intermediate transfer body 2. In the following description, when the content is common in all the photoreceptors, the photoreceptors are represented as the photoreceptor 3.

Each of the photoreceptors 3B, 3Y, 3C and 3M has a drum rotatable in the same direction (in FIG. 1, counterclockwise). Around the drum, there are provided devices (i.e. a charging device 4, a writing device 5, a developing device 6, a primary transfer device 7 functioning as a transfer bias applicator and a cleaning device 8) performing image formation in the rotation process of the drum. For convenience, these devices are numbered only for the photoreceptor 3B.

The intermediate transfer belt 2 corresponds to the primary transfer portion where visualized images are sequentially transferred from each image formation unit having a photoreceptor. The intermediate transfer belt 2 is suspended over multiple rollers 2A to 2C and has a structure such that the intermediate transfer belt 2 can rotate in the same direction as the photoreceptors at the place where both meet. The rollers 2A and 2B form the extension phase of the intermediate transfer belt 2 and the roller 2C opposes a secondary transfer device 9 with the intermediate transfer belt 2 therebetween.

The secondary transfer device 9 is suspended over a charging driving roller 9A and a driven roller 9B. At the secondary transfer portion, the secondary transfer device 9 has a transfer belt 9C which can move in the same direction as the intermediate transfer belt 2. By charging the transfer belt 9C by the charging driving roller 9A, a recording medium is electrostatically attracted and transferred in the process of transferring the recording medium. In this process, the overlapped multi-color image or each borne monochrome color image on the intermediate transfer belt 2 is transferred to the recording medium.

The recording medium is fed to the secondary transfer position from the recording medium feeding portion 1B. The recording medium feeding portion 1B has multiple paper feeding cassettes 1B1, multiple transfer rollers 1B2 provided in the transfer path of a recording medium fed from the paper feeding cassette 1B1, and a pair of registration rollers 1B3 located before the secondary transfer position. In this embodiment, the recording medium feeding portion 1B has a structure for feeding a recording medium different from the recording medium accommodated in the paper feeding cassette 1B1*s* in addition to the transfer path for a recording medium fed from the paper feeding cassette 1B1. This structure has a manual tray 1A1 and a pair of feeding rollers 1A2*s*. The manual tray 1A1 can be folded to be in the plane of the wall of the image formation portion 1A.

A transfer path of a recording medium fed from the manual tray 1A1 flows to the middle of the transfer path of a recording medium from the paper feeding cassette 1B1*s* to the registration rollers 1B3. The registration timing of the recording medium fed from either of the transfer paths is set by the registration roller 1B3.

Image information is obtained by scanning a document set on the document setting table 1C1 of the document scanning portion 1C or from output from a computer (not shown). The writing device 5 (in FIG. 1, writing light for black image formation is represented by 5B) forms a latent electrostatic image on the photoreceptors 3B, 3Y, 3C and 3M based on the image information which controls the writing light.

The document scanning portion 1C has a scanner 1C2 scanning a document on the document setting table 1C1. Above the document setting table 1C1, an automatic document feeding device 1C3 is provided The automatic document feeding device 1C3 has a structure in which a document fed to the document setting table 1C1 can be reversed so that both sides of the document can be scanned.

The latent electrostatic images formed on the photoreceptor 3 (3B, 3Y, 3C and 3M in FIG. 1) by the writing device 5 are visualized by a developing device 6 (represented by 6B in FIG. 1) followed by primary transfer to the intermediate transfer belt 2. When each color toner image is overlapped on the intermediate transfer belt 2, the overlapped image is secondarily transferred at one time to a recording medium by the secondary transfer device 9.

The unfixed image on the surface of the recording medium after the secondary transfer is fixed by a fixing device 11. The fixing device 11 has a fixing belt heated by a heating roller and a pressing roller. The fixing belt and the pressing roller are opposed to each other in a contact manner. This system has a nip area (i.e., contact area) so that the heating area for a recording medium is relatively wide in comparison with another fixing structure taking a different roller system.

The transfer direction of the recording medium which has passed the fixing device 11 can be switched by a transfer path switching claw 12 provided at the back of the fixing device 11 to a transfer path towards a discharging tray 13 or to a reversing transfer path RP.

In the image forming apparatus 1 having the structure described above, a latent electrostatic image is formed on the uniformly charged photoreceptor 3 based on the image information obtained by scanning a document set on the document setting table 1C1 or the image information from a computer. After the latent electrostatic image is visualized by the developing device 6, the toner image is primarily transferred to the intermediate transfer belt 2.

When the toner image transferred to the intermediate transfer belt 2 is a monochrome image, the toner image is simply transferred to a recording medium fed from the paper feeding portion 1B. When the toner image transferred to the intermediate transfer belt 2 is a multiple color image, an overlapped image is formed after primary transfer is repeatedly performed and the overlapped image is secondarily transferred to a recording medium at one time. After the secondary transfer and fixing of the image on the recording medium, the recording medium is guided to the discharging tray 13 or is reversed and guided to the registration rollers 1B3 again.

In FIG. 1, the intermediate transfer belt 2 has, for example, a base layer and an elastic layer thereon. The base layer has a base portion containing a hardly stretchable fluorine resin, stretchable rubber and a hardly stretchable material (e.g., canvas). The elastic layer contains fluorine based rubber, acrylonitrile-butadiene copolymer rubber, etc. A fluorine resin covers the surface of the elastic layer as a coat layer to ameliorate the smoothness of the elastic layer.

The intermediate transfer belt 2 is suspended over the pair of suspending rollers 2A and 2B and the roller 2C having a back-up function. The intermediate transfer belt 2 is driven by the counterclockwise rotation of the driving roller 2A.

The extended phase (surface) between the supporting rollers 2A and 2B, meaning a plane having no curvature, is opposed to the photoreceptors 3B, 3Y, 3C and 3M of each image formation unit. At the position opposing each photoreceptor with the intermediate transfer belt 2 therebetween, a transfer roller 7B is arranged for each to electrostatically transfer the visualized image on the photoreceptor.

The cleaning device of the present invention is provided for an intermediate transfer belt. The cleaning device has a first cleaning portion 10 provided before the image formation positions and a second cleaning portion 100 for cleaning the ends of the intermediate transfer belt 2 relative to the breadth direction thereof. The second cleaning portion 100 is in the upstream position in the moving direction of the intermediate transfer belt 2 relative to the cleaning device 10.

Figure 2:
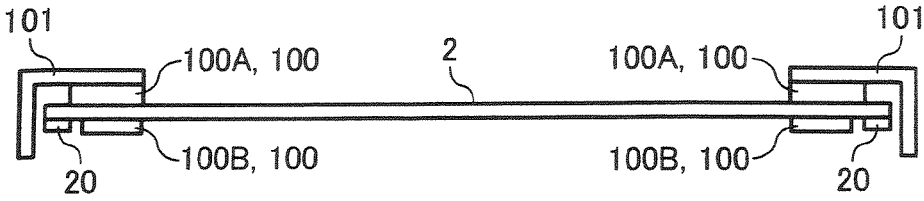
FIG. 2 is a cross-section illustrating the structure of the cleaning device.
Figure 3:
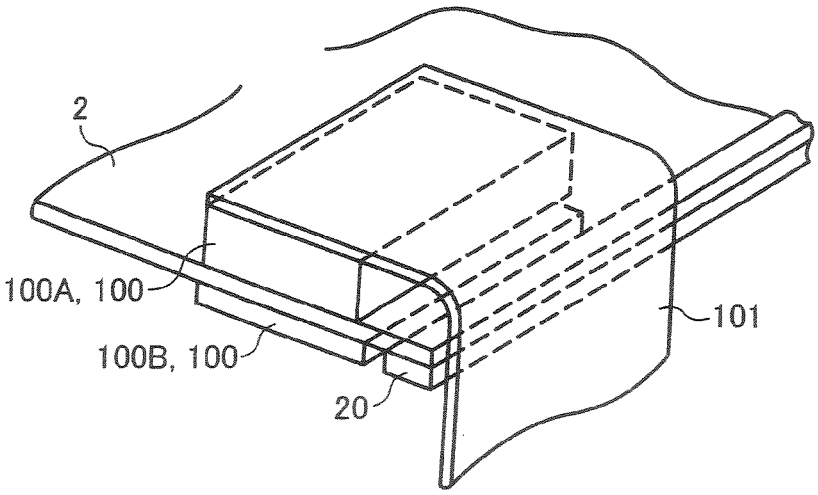
FIG. 3 is a perspective view of a part of the structure illustrated in FIG. 2.

FIG. 2 is a cross section of the intermediate transfer belt 2 along the breadth direction thereof to illustrate the structure of the second cleaning portion 100 shown in FIG. 1 which includes a cleaning member 100A and a fixing member 100B. The cleaning member 100A and the fixing member 100B are opposed to each other with the intermediate transfer belt 2 therebetween and are located near each end in the breadth direction (i.e., right angle to the moving direction of the intermediate transfer belt 2) of the intermediate transfer belt 2. A supporting member 101 supports the cleaning member 100A. Reference numeral 20 in FIG. 2 represents a belt guiding portion which contacts the end of the roller in the axis direction thereof so that the intermediate transfer belt 2 can be prevented from meandering. FIG. 3 is a perspective view of the elements of the right side of FIG. 2.

Figure 4:
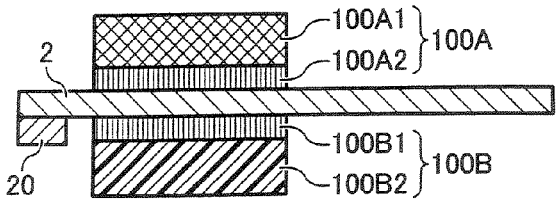
FIG. 4 is a cross section illustrating the detailed structure of a part illustrated in FIG. 2.

As illustrated in FIG. 4, the cleaning member 100A has a foamed material 100A1 and a brushing material 100A2. The foamed material 100A1 is supported by the supporting member 101 on the reverse side to the side opposing the intermediate transfer belt 2. The supporting member 101 is provided on a stable portion in the device which preferably has little or no movement during operation. The brushing material 100A2 is provided on the position opposing the intermediate transfer belt 2.

In this embodiment, sponge material (e.g., foamed polyurethane) or foamed rubber material is used as the foamed material. The foamed material can sink into and/or conform to the surface of the intermediate transfer belt 2 when the foamed material is pressed into contact with the intermediate transfer belt 2 so that toner can be banked up.

The brushing material 100A2 is made by brush-filling by electrocoating materials, for example, nylon and rayon. The brushing material 100A2 is to prevent unintentional abrasion or grinding of the surface of the intermediate transfer belt 2 when banking up toner.

The fixing member 100B has the main body 100B2 provided on any stable surface which preferably has little or no movement during operation. There is also a brushing member 100B1 provided on the side opposing the intermediate transfer belt 2.

The main body 100B1 of the fixing member 100B is made of a relatively hard resin or metal. The brushing member 100B1 preferably uses the same material as the material for use in the cleaning member 100A, although different materials can be used, if desired.

The fixing member 100B is a member for making the contact pressure between the intermediate transfer belt 2 and the cleaning member 100A uniform. Thus, the intermediate transfer belt 2 can be prevented from waving so that the position relationship of the intermediate transfer belt 2 to the cleaning member 100A can be constantly maintained.

The fixing member 100 is preferably set in an immovable or stable status. It is also possible for the fixing member 100 to elastically transform in the up and down direction according to the contact pressure of the cleaning member 100A to the intermediate transfer belt 2. In this structure, the contact pressure caused by the position relationship set for the cleaning member 100A to the intermediate transfer belt 2 can be uniformly maintained.

Figure 5:
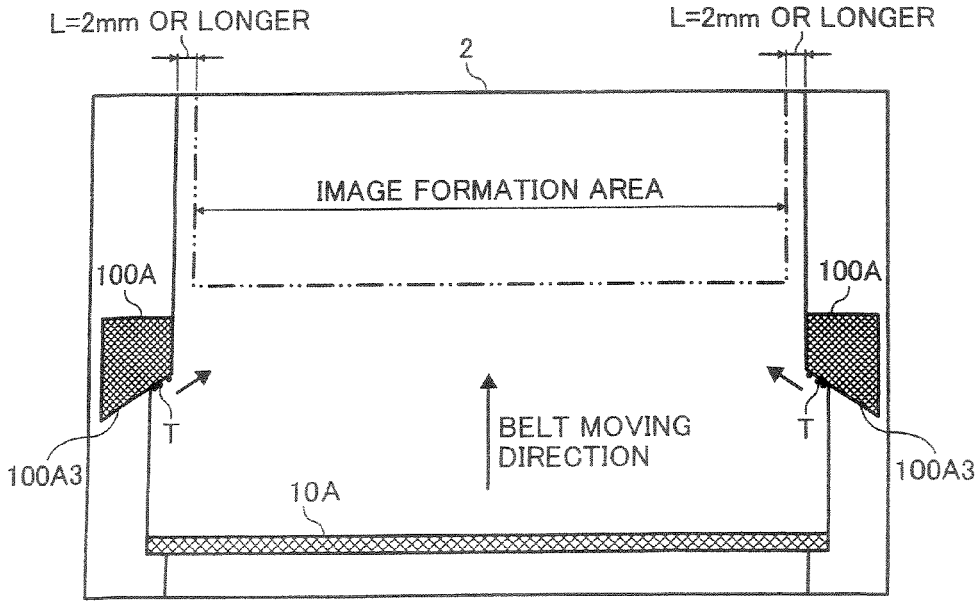
FIG. 5 is a plain view illustrating the detailed structure of a part of the cleaning device illustrated in FIG. 2.

The cleaning member 100A has a structure in which the banked-up toner is moved to the breadth direction of the intermediate transfer belt 2. FIG. 5 is a diagram illustrating this structure. In FIG. 5, the cleaning member 100A has a slanting side 100A3 relative to the breadth direction of the intermediate transfer belt 2.

The slanting side 100A3 is situated on the upstream side of the moving direction (indicated by the arrow) of the intermediate transfer belt 2. Thus, toner T on the end sides can be moved toward the center of the breadth direction of the intermediate transfer belt 2. As shown in FIG. 5, the slanting side 100A3 forms an oblique line in a triangle having the two sides of the cleaning member 100A parallel to the moving direction and the breadth direction of the intermediate transfer belt 2 with a right angle therebetween.

By having this slanting side 100A3, the toner is moved to the image formation area and the moved toner can be scraped by a blade 100A provided to the cleaning device 10. Consequently, the toner can be prevented from slipping off the end sides of the intermediate transfer belt 2.

In FIG. 5, the cleaning member 100A is provided outside both ends of the image formation area of the intermediate transfer belt 2. According to one embodiment, the inner end of the cleaning member 100A is at least 2 mm from the end of the image formation area of the intermediate transfer belt 2. In addition, the inner end is situated inside the ends of the blade 10A located in the first cleaning portion in the longitudinal direction of the cleaning blade 10.

Figure 6:
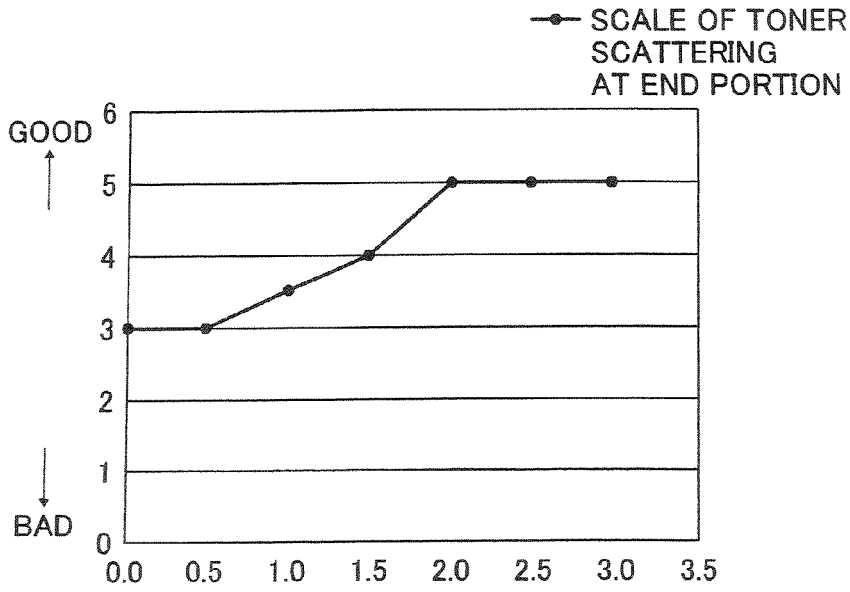
FIG. 6 is a graph illustrating the result of an experiment based on the positional relationship of the detailed structure illustrated in FIG. 5.

The reason for regulating the positioning of the cleaning material 100A relative to the image formation area is based on the experiment result illustrated in FIG. 6. FIG. 6 is a diagram illustrating the result of the experiment for the toner contamination and damage based on the ends of the image formation area and the position of the cleaning material 100A. The experiment is repeated 10 times. When the distance between the end of the image formation area and the position of the cleaning material 100A is at least 2 mm, the evaluation is good (the criterion evaluation is 4). When the positional relationship is set as mentioned above, toner hardly leaks from the ends. Thus, it is found that toner is moved by the cleaning member 100A from the ends to the center in the breadth direction and the blade of the cleaning device can excellently scrape, resulting in reduction of toner contamination.

In this embodiment, toner which may slip from the end sides is banked up by the cleaning material 100A and is moved from the end to the center (i.e., away from the ends). It is thus possible to perform excellent cleaning without a complicated cleaning structure in which a cleaning member having a function similar to that of a scraping member has multiple functions.

Next, another embodiment is described.

Figure 7:
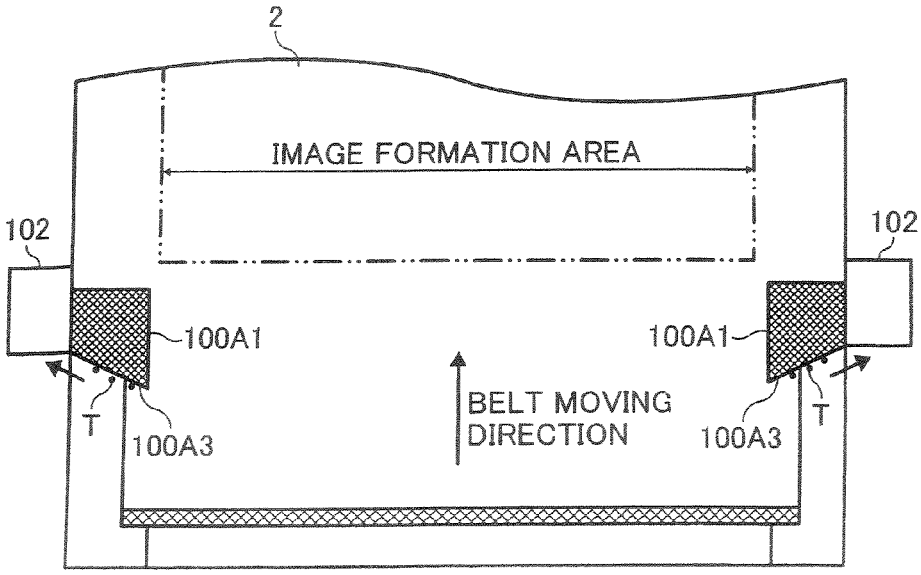
FIG. 7 is a diagram illustrating another example of the cleaning device illustrated in FIG. 2.

FIG. 7 is a diagram illustrating another example structure in which toner banked up by the cleaning member 100A is moved in the breadth direction of the intermediate transfer belt 2. The slanting side 100A3 of the cleaning member 100A in this structure has a reversed angle to that in the case illustrated in FIG. 5. In this structure, the toner is moved toward the outside of the intermediate transfer belt 2. Therefore, a toner collecting portion 102 is provided at both sides of the belt to collect the toner removed by the cleaning member. This structure can be used, for example, when it is impossible to set the position relationship between the cleaning member 100A and the image formation area as illustrated in FIG. 5.

Next, another embodiment of the present invention is described below.

Figure 8:
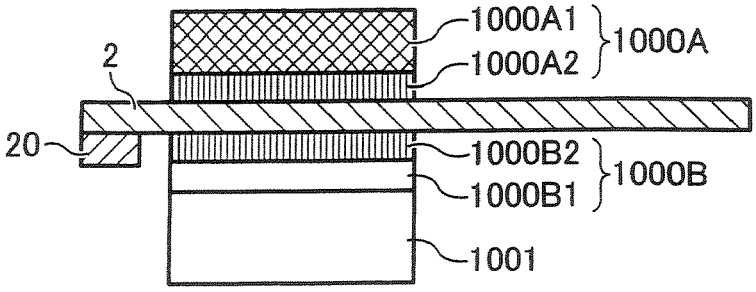
FIG. 8 is a cross section illustrating the detailed structure of a part illustrated in FIG. 7.

The embodiment illustrated in FIG. 8 has a control device for controlling the speed of the intermediate transfer belt 2 based on feedback information obtained by detecting an encode mark(s) (scale) P formed on the intermediate transfer belt 2. The encode mark(s) is/are detected by a detecting device 1001 which may be part of the second cleaning portion. The speed control based on the usage of such a scale is described in, for example, JOP H11-24507, which is incorporated herein by reference.

FIG. 8 is a cross section similar to FIG. 4. There is a cleaning portion 1000A and a fixing member 1000B with the intermediate transfer belt 2 therebetween. The cleaning portion 1000A and the fixing member 1000B are opposed to each other. As illustrated in FIG. 8, the cleaning portion or member 1000A has a foamed material 1000A1 and a brushing material 1000A2.

Figure 9:
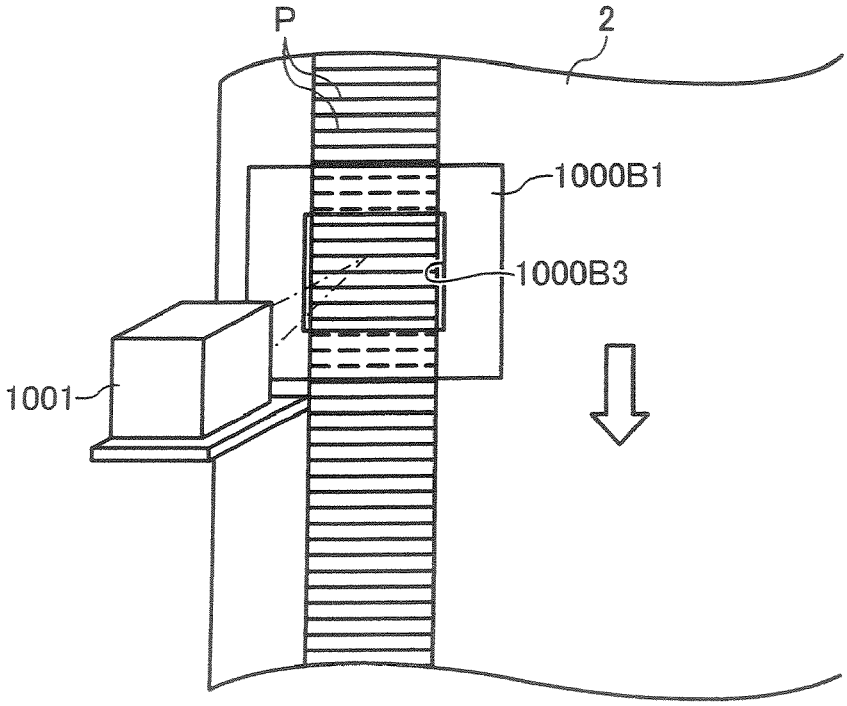
FIG. 9 is a dissembled perspective view of the cleaning device illustrated in FIG. 8.
Figure 10:
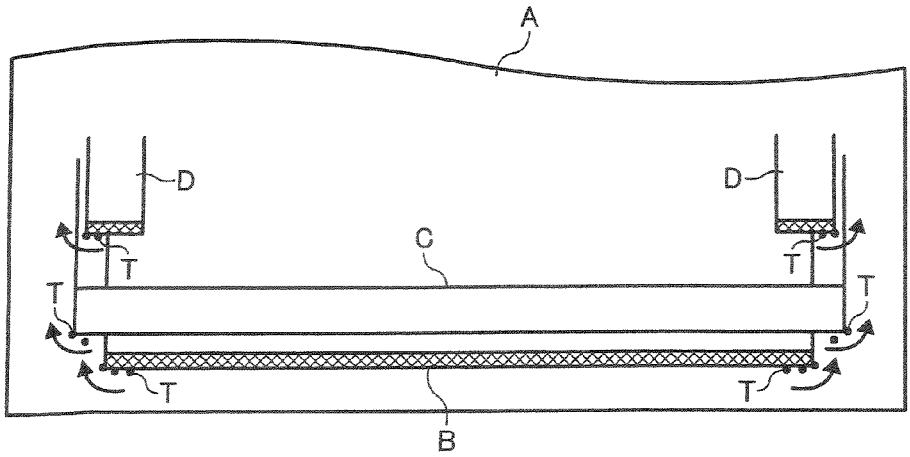
FIG. 10 BACKGROUND ART
FIG. 10 is a diagram illustrating an example of a background art cleaning device.

The fixing member 1000B is also used as a member to which a detecting member 1001 is attached. The detecting member 1001 has an optical sensor for detecting the reflecting light from the encode mark P. To be specific, as illustrated in FIG. 9, the fixing member 1000B has a supporting substrate 1000B1 having an opening 1000B3 for light transmission and the brushing material (not shown) provided on the side of the intermediate transfer belt 2.

The detecting device 1001 is integrally attached to the supporting substrate 1000B1. Although the detecting device 1001 is illustrated in a dissembled manner to illustrate the structure of the supporting substrate 1000B1 in FIG. 9, the detecting device 1001 is usually integrated into the supporting substrate 1000B1 as illustrated in FIG. 8. The supporting substrate 1000B1 for use in the fixing member 1000B is supported by any suitable stable portion of an image forming apparatus.

In this embodiment, since the supporting structure of the detecting member 1001 can be used as a cleaning portion, the number of parts can be reduced and the structure can be made simple. In addition, since the optical light path length between the encode mark P and the detecting member 1001 is substantially constant, the precision of the scale reading by the detecting member 1001 is high. Furthermore, toner near the edges of the belt which may fall off and scatter is removed so that the detecting member 1001 is prevented from being contaminated, which leads to avoidance of deterioration of the detection precision. The control device connected to the detecting member 1001 may be implemented in any desired manner, including by a programmed controller, integrated circuits, computer chips, or in any other way.

This document claims priority and contains subject matter related to Japanese Patent Application No. 2006-122104, the entire contents of which are incorporated herein by reference.

Obviously, numerous modifications and variations of the present invention are possible in light of the above teachings.

It is therefore to be understood that within the scope of the appended claims, the invention may be practiced otherwise than as specifically described herein.

Having now fully described the invention, it will be apparent to one of ordinary skill in the art that many changes and modifications can be made thereto without departing from the spirit and scope of the invention as set forth therein.

What is claimed is:

1. A cleaning device comprising:

a first cleaning portion comprising a cleaner to clean a belt transfer body a position downstream of a transfer position along a conveyance direction; and a second cleaning portion comprising a cleaning member which is different from the cleaner of the first cleaning portion and contacts the belt transfer body, the cleaning member being located only at an end of the belt transfer body in a breadth direction which is perpendicular to the conveyance direction and a support member configured to press the belt transfer body to the cleaning member, the support member being located at a position opposing the cleaning member with the belt transfer body therebetween, wherein the first cleaning portion is located at a first distance in the conveyance direction from a reference point, and the second cleaning portion located at a second distance in the conveyance direction from the reference point which is different from the first distance.

2. The cleaning device according to claim 1, wherein the cleaning member comprises a brushing member on a side thereof which contacts the belt transfer body.

3. The cleaning device according to claim 1, wherein the support member comprises a brushing member on a side thereof which contacts the belt transfer body.

4. The cleaning device according to claim 1, wherein the cleaning member has a slant side relative to the breadth direction of the belt transfer body, the slant side being located on the upstream side relative to the conveyance direction.

5. The cleaning device according to claim 4, wherein the slant side is slanted such that toner located on the end side is moved toward a center of the belt transfer body relative to the breadth direction thereof.

6. The cleaning device according to claim 1, wherein the cleaning member is located at least a predetermined length away from the end of an image formation area of the belt transfer body in the breadth direction.

7. An image forming apparatus, an image bearing member configured to bear a latent image thereon;

a charging device configured to charge the image bearing member;

a developing device configured to develop the latent image with a developing agent;

a belt transfer body configured to transfer the latent image;

a discharging device configured to discharge the image bearing member;

the cleaning device of claim 1; and a detecting device configured to detect a moving speed of the belt transfer body.

8. The cleaning device according to claim 4, wherein the slant side is slanted such that toner located on the end side is moved away from a center of the belt transfer body relative to the breadth direction thereof.

9. A cleaning device comprising:

a first cleaning comprising a cleaner to clean a belt transfer body at a position downstream of a transfer position along a conveyance direction; and a second cleaning portion comprising a cleaning member which is different from the cleaner of the first cleaning portion and contacts the belt transfer body, the cleaning member being located only at an end of the belt transfer body in a breadth direction which is perpendicular to the conveyance direction, and a support member configured to press the belt transfer body to the cleaning member, the support member being located at a position opposing the cleaning member with the belt transfer body therebetween, wherein the cleaning member has a slant side relative to the breadth direction of the belt transfer body, the slant side being located on the upstream side relative to the moving direction of the belt transfer body.

10. The cleaning device according to claim 9, wherein the slant side is slanted such that toner located on the end side is moved toward a center of the belt transfer body relative to the breadth direction thereof.

11. The cleaning device according to claim 9, wherein the slant side is slanted such that toner located on the end side is moved away from a center of the belt transfer body relative to the breadth direction thereof.

* * * * *